US006793467B2

(12) United States Patent
Hudelmaier

(10) Patent No.: US 6,793,467 B2
(45) Date of Patent: Sep. 21, 2004

(54) THICK MATTER PUMP

(75) Inventor: Gerhard Hudelmaier, Ulm (DE)

(73) Assignee: Jorg Hudelmaier, Ulm (DE)

( * ) Notice: Subject to any disclaimer, the term of this patent is extended or adjusted under 35 U.S.C. 154(b) by 0 days.

(21) Appl. No.: 10/129,953

(22) PCT Filed: Nov. 29, 2000

(86) PCT No.: PCT/EP00/11966

§ 371 (c)(1),
(2), (4) Date: Oct. 1, 2002

(87) PCT Pub. No.: WO01/40649

PCT Pub. Date: Jun. 7, 2001

(65) Prior Publication Data

US 2003/0143089 A1 Jul. 31, 2003

(30) Foreign Application Priority Data

Nov. 29, 1999 (DE) ..... 199 57 337

(51) Int. Cl.[7] ..... F04B 17/00; F04B 35/00
(52) U.S. Cl. ..... 417/379; 417/900; 417/516
(58) Field of Search ..... 417/379, 900, 417/516–519; 137/625.48, 625.49, 625.4, 625.33, 625.34; 251/175

(56) References Cited

U.S. PATENT DOCUMENTS 3,327,641 A * 6/1967 Klosterman ..... 417/507
3,663,129 A * 5/1972 Antosh ..... 417/516
3,682,575 A * 8/1972 Guddal et al. ..... 417/517
3,771,561 A * 11/1973 Santamaria ..... 137/872
3,829,251 A * 8/1974 Schwing ..... 417/477.8
3,854,694 A 12/1974 Coone ..... 251/5
4,884,594 A 12/1989 Powers et al. ..... 137/625.48
4,893,992 A * 1/1990 Schlecht ..... 417/238

FOREIGN PATENT DOCUMENTS

| | | |
|---|---|---|
| AU | 492 344 B | 11/1975 |
| DE | 20 40 400 | 2/1972 |
| EP | 0 315 750 | 5/1989 |
| FR | 737 900 | 12/1932 |
| FR | 42 578 | 8/1933 |
| FR | 2 071 976 | 9/1971 |

* cited by examiner

*Primary Examiner*—Justine R. Yu
*Assistant Examiner*—Han L Lin
(74) *Attorney, Agent, or Firm*—Armstrong, Kratz, Quintos, Hanson & Brooks, LLP

(57) ABSTRACT

The present invention relates to a thick matter pump comprising at least two pump units alternating in the pump and suction mode, a delivery line, a suction line and a switching valve for switching between the pump units, one pump unit being connected in the pump mode by the switching valve to the delivery line, and one pump unit being connected to the suction line in the suction mode. The filling level of the pump unit in the suction mode is to be improved. To this end a pressure boosting device which acts independently of the pump units is provided in the area of the suction line for actively effecting a precompression of thick matter. The invention also relates to a suction/pumping method which is carried out by said thick matter pump.

26 Claims, 3 Drawing Sheets

THICK MATTER PUMP

BACKGROUND OF THE INVENTION

The present invention relates to a thick matter pump comprising at least two pump units alternating in the pump and suction mode, a delivery line, a suction line, and a switching valve for switching between the pump units, one pump unit being connected in the pump mode by the switching valve to the delivery line, and one pump unit being connected in the suction mode to the suction line.

Thick matter pumps are used in very many cases for conveying concrete, but materials of a similar type can also be conveyed by such pump units. Known are, in particular, pump arrangements in which the pump units are formed by cylinder/piston pumps which are alternately connected via a pipe slide to a delivery line or to a suction line. There are arrangements in which the pipe slide is arranged within a supply container and in the suction mode the cylinder/piston pump directly sucks the thick matter from the supply container. The supply container is upwardly open in most cases, so that thick matter can be refilled.

In other pump constructions, a suction line terminates at the lower end of a supply container, the thick matter being discharged through the suction line. A conveying unit, e.g. a screw, can also be arranged thereby in the supply container for ensuring a better filling degree. The other end of the suction line section leading away from the supply container is followed by a pipe slide housing, which ensures a suitable switching between the pump units and a connection of the pump unit either to the delivery line or to the suction line.

With all of these different pump constructions, attempts are made to produce a pump flow which is as continuous as possible, despite the switching operation of the pipe slide.

In a generic construction which is disclosed in DE 197 35 091 A1, a well-known activation method for the pump units is resorted to and used with a pipe slide device arranged outside of the supply container. In this known method the cylinder/piston pump operates faster in the suction mode than in the pump mode, whereby the suction operation of the one pump unit is already completed while the pump operation of the other pump unit still continues. Subsequently, the thick matter fillings which are in contact with the first pump unit are separated from the supply container by means of slide elements, which are also known. The thick matter is subsequently precompressed by means of the delivery piston of the first pump unit until a desired pressure is built up. Meanwhile the second pump unit is still in the pump mode. It is only after the application of the preloading pressure that the pipe slide switches over. The one end of the pipe slide is in permanent contact with the suction line section leading away from the supply container, whereas the delivery line is in permanent communication with the cavity of the pipe slide housing. The preloaded thick matter comes now in contact with the pressurized thick matter in the pipe slide housing. This operation does not lead to any vibrations in the delivery column because the preload is preferably at the pressure level in the delivery line and the thick matter column does therefore not slump in the delivery line. As soon as the second pump unit has completed its pumping operation, the first pump unit takes over the pumping operation. Subsequently, the second pump unit is connected to the supply container by means of the pipe slide and by opening the slide. The cycle starts again with exchanged pump units.

Constructions in which the pipe slide is in permanent communication with the delivery line and the suction line section leads to the pipe slide housing can also be operated with such a method on condition that corresponding slides are used. See, for instance, the construction in DE 196 41 771 A1.

Said constructions, however, have the drawback that part of the delivery volume of the pump units is wasted because of this preloading operation. That is why the pump units must have a larger size than would be necessary.

SUMMARY OF THE INVENTION

It is therefore the object of the present invention to provide a thick matter pump of the above-mentioned type which allows an improved design of the pump units.

To this end a pressure boosting device which is independently operative of the pump units is provided according to the invention in the area of the suction line for actively effecting a thick matter precompression.

This means that, either independently of the pump unit or in support thereof, there is provided a separate device which from the direction of the suction line effects a pressing of the thick matter for providing a precompression. When a cylinder/piston pump is used, the necessary path for a precompression is reduced thereby, or a path is no longer needed at all when the pressure boosting device entirely takes over the precompressing operation. Thus, the pump units need no longer convey the very volume required for precompression. This reduces the size of the pump units. Moreover, this yields a further positive effect. Thanks to the active pressing of the thick matter by the pressure boosting device, the pump unit and suction line, respectively, are filled in an improved way. So far the cross-sections of the openings of cylinder/piston pumps have required a specific size, for instance for concrete, so that a high filling of the cylinder could be achieved by the action of negative pressure. The size of this opening can now be reduced due to the continuous supply of the thick matter by the pressure boosting device. This, however, has also the effect that the pump units can be arranged closer to each other and the switching times can thereby be reduced considerably, e.g. by using a pipe slide. The elements which follow the openings, for instance pipe slides, etc., can also be reduced in size, which is of great advantage in particular with respect to the forces acting within the system due to the thick matter pressure. Thick matter which is difficult to suck can also be pumped with the help of a pressure boosting device without any problems. Moreover, the pump unit can be operated in the suction mode at a faster pace because the losses in the sucking action can be compensated by the pressure boosting device. A separate pressure boosting device is excellently suited for a later modification of existing thick matter pumps. When existing pump units are kept and when the separately acting pressure boosting device is now used in addition in accordance with the invention, the pumping efficiency can be improved by up to 20% due to the better filling of the pump unit in the suction mode.

In an advantageous embodiment, the suction line comprises an elastically deformable section and the pressure boosting device comprises squeezing elements by which the elastically deformable section of the suction line can be compressed for increasing the pressure. Advantageously, such a deformable section can be connected to a supply container. Suitable squeezing elements will then ensure a closing of the elastically deformable section with subsequent pressure build-up. Due to the relatively low compressibility of the thick matter, air inclusions must mainly be overcome. The deformable section is therefore deformed to such a degree that the desired pressure build-up is achieved in the suction line. This could also be carried out with the help of a plurality of squeezing elements. Moreover, a squeezing element may be designed with respect to its shape such that said function takes place in one operation.

Moreover, it is also possible that rotatably supported squeezing elements first compress the deformable section and thus close the suction line and are then moved towards the pump unit. This process reminds of the delivery of media by means of a hose pump. That is why according to one variant it is additionally of advantage when the elastically deformable section of the suction line is a hose piece. Hose pieces that withstand correspondingly high pressures are very well known in the prior art.

Hose pumps are already used in part for conveying concrete, so that enough examples can be found in the prior art with respect to the selection of the material and the reinforcement of the hose piece. Preferably, said hose piece can be interposed by means of suitable coupling elements into the suction line, which permits a rapid exchange in case of repair or wear and also permits a more flexible arrangement. Suitable hose pieces for such squeezing purposes have a sufficiently long service life.

In another variant of the pressure boosting device, said device comprises a membrane. On the one hand, a membrane can be pressurized at one side by very different media, resulting in a bulge which achieves the desired precompressing and pressing effect.

In a particularly sturdy and low-maintenance design, the pressure boosting device comprises a cylinder/piston unit. Said unit could e.g. be configured to be identical with or similar to a pump unit, preferably with smaller dimensions, and e.g. terminate laterally into the suction line.

When the pumping capacity of the pressure boosting device is greater than the suction capacity of one of the pump units, this has the additional advantage that the pressure boosting device can start its precompressing operation already during the suction operation, in particular in the end phase, and superpose the same. The suction operation and the precompression process could be matched in an optimum manner to each other such that both processes end at the same time.

Preferably, the pressure boosting device can comprise adjusting means for adjusting the thick matter compression. Advantageously, the force by which e.g. squeezing elements press onto a hose piece could be determined to this end. Thus even without a direct pressure measurement in the thick matter line, the pressure prevailing there can thereby be deduced. The pump behavior for reducing pump impacts can be optimized by adjusting the pressure. Different precompression pressures may be of relevance to the different thick materials.

To avoid damage to the thick matter pump, the pressure boosting device may comprise an overload protection for limiting the maximum precompression of thick matter. In the case of clogging or switching trouble, etc., this could be of great advantage, in particular, in order to protect an elastically deformable section of the suction line.

The pressure boosting device can operate independently or can be coupled directly with the drive of the pump units. According to one variant, it is of advantage when the squeezing elements of the pressure boosting device are operable by a hydraulic means. The hydraulic circuit for the squeezing elements can directly be coupled with a hydraulic circuit for the pump units, so that there is a direct dependence. However, all of the other possible activation constructions are also possible.

For thick matter, such as concrete, delivery cylinders with delivery pistons have turned out to be particularly suited as pump units; that is why these are preferably used according to one embodiment. The pressures desired for the delivery of concrete can be exerted by means of such pump units for achieving very high delivery heights.

Moreover, pipe slides with pivot pipe bodies have turned out to be suited for such a use as a switching valve because these turn out to be relatively insensitive to the medium to be pumped. One variant provides for a corresponding application.

The present invention could also be used with pipe slides arranged within a supply container. According to a particular development, however, the pipe slide comprises a housing which surrounds the pivot pipe body at least in portions at a distance, a cavity formed between the housing and the pivot pipe body is part of the delivery line, and the pivot body which can be switched between the pump units is part of the suction line. Such an arrangement does not create any sealing problems on the pivot pipe body (in particular S pipe) and on a plate. Moreover, there are only slight or no reaction forces acting on the pivot pipe body (in particular S pipe) and the bearing thereof.

In a further embodiment, the pipe slide comprises a housing which surrounds the pivot pipe body at least at a distance, a cavity which is formed between the housing and the pivot pipe body forms part of the suction line, and the pivot pipe body which can be switched between the pump units forms part of the delivery line. The conditions prevailing in such a variant are sufficiently known from standard constructions and can be mastered. Moreover, during the switching of the pivot pipe body the same pressure prevails as in the other embodiment because the housing is also subjected to pressure by the pressure boosting device.

Since the inner wall of the housing is in permanent contact with thick matter and a pivot pipe body slides along parts of the inner wall, at least part of the inner wall of the housing is provided at least in portions with wear elements according to one variant. Said wear elements can then be replaced.

It makes also sense when according to one embodiment the housing comprises at least one closable maintenance or cleaning opening.

Preferably, one end of the suction line is connectable to a supply container. Finally, it is possible to arrange the switching valve in a flexible manner, for instance on a concrete mixer vehicle. The filling of the suction line can also be supported by said arrangement because the full pressure of the thick matter from the supply container can act thereon.

Advantageously, the supply container is vertically adjustable and made pivotable. This is very easily possible in particular in embodiments in which the switching valve is not directly arranged in the supply container itself. The vertical adjustment also increases the filling pressure of the suction line.

Moreover, the invention also refers to a suction/pumping method for a thick matter pump employing apparatus disclosed herein. The method comprises the following steps:

connecting the delivery line to a first pump unit,
connecting the suction line to a second pump unit,
the first pump unit switching to pump mode,
the second pump unit switching to suction mode, precompressing and pressing the thick matter into the suction line by means of a pressure boosting device performing a compressing operation independently of the first pump unit until the desired precompression or filling amount is achieved in the second pump unit.

Accordingly, the method has the advantage that a precompression can take place by means of a pressure boosting device, also independently of a pressure-applying pump unit. The pump unit is activated in a much simpler way because the precompression considerably depends on a separate operation of a pressure boosting device. Therefore, the method provides a continuous delivery flow. The method steps will then take place after a switching operation for the respectively other pump unit (first pump unit in the suction mode, second pump unit in the pump mode) until the cycle begins anew. The sequence of the individual process steps takes place partly at the same time or in overlapping fashion. In particular, the recompressing and pressing operation can take place after completion of the suction mode, in a way overlapping with the suction mode or during the suction mode with simultaneous completion.

The simplest construction is achieved when the first pump unit is at a standstill during the precompressing step by the pressure boosting device or terminates the suction mode. The optimum filling of the pump unit is then determined through the pressure boosting device. This will then correspond at the same time to the highest possible filling level by which the efficiency of the pump units can be increased to a considerable extent.

A further variant of the method is that in the end phase of the suction mode of the second pump unit the pressure boosting device is activated with a capacity superposing the suction mode of the second pump unit. The end phase will then mainly be defined by the pressure boosting device which will then press the thick matter. At the same time, however, the second pump unit completes its suction mode to assume its maximum filling position. During this whole process the desired compression of thick matter can already be obtained although the second pump unit has not yet completed its suction mode entirely.

Advantageously, the second pump unit terminates the suction mode at the same time with the precompressing and pressing operation in this case. This means that as soon as the second pump unit has finished the suction mode, there is a completely preloaded thick matter column which can then be pressed into the delivery line by switching to the pump mode. Thus, no time losses are created by the precompressing operation.

Irregularities in the delivery flow, in particular a slumping back of the thick matter column into the delivery line can be reduced according to one variant in that a pressure is built up in the suction line by precompression, the pressure being substantially identical with the pressure in the delivery line during the pump mode. During switching from the one to the other pump unit, the precompressed thick matter comes into contact with the thick matter in the delivery line. Since both have substantially the same pressure, no vibrations are created in the thick matter column.

For a further optimization of the switching operation, a further embodiment provides for an operation in which during a switching process from the first to the second pump unit both pump units work at half the volume flow in the pump mode. Overlaps which occur during the switching operation, e.g. due to a switching valve, are thereby compensated. A delivery flow which is as constant as possible is the result also during the switching process.

BRIEF DESCRIPTION OF THE DRAWINGS

Embodiments of the invention will now be explained in detail in the following with reference to a drawing, in which.

DESCRIPTION OF PREFERRED EMBODIMENTS OF THE INVENTION

Figure 1A:
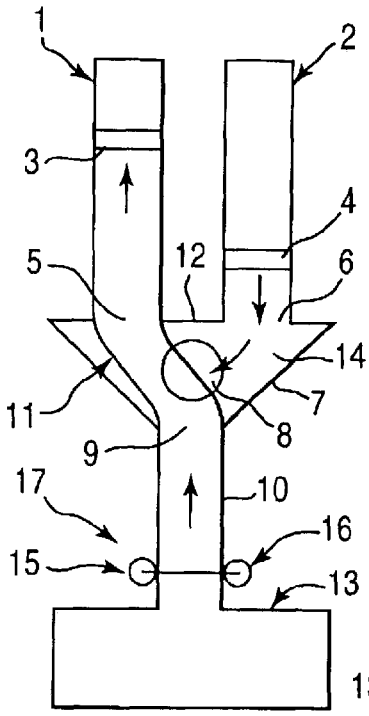
FIGS. 1*a* to 1*d* show a schematic process sequence of the pumping operation in a two-cylinder thick-matter pump.
Figure 1B:
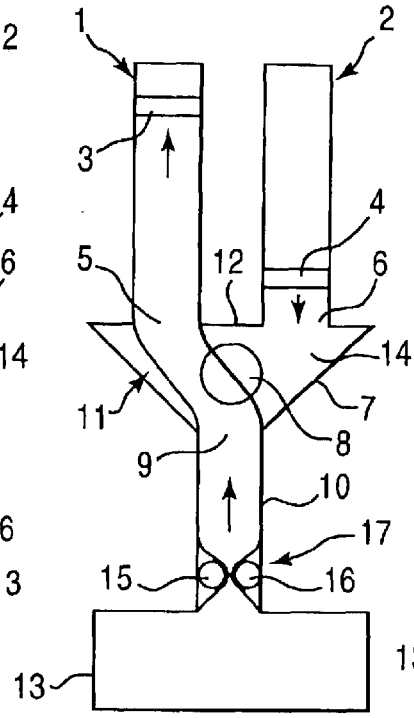

The construction of the pump is shown only schematically in the drawings. For some of the subassemblies enough examples can however be found in the prior art as to how these are constructed in detail, so that reference is made to said prior art.

Thick matter pump shown in FIGS. 1*a* to 1*d* primarily serves to deliver concrete. Said pump comprises a first pump unit 1 and a second pump unit 2. The pump units land 2 are cylinder/piston pumps which either suck or pump the thick matter by means of longitudinally movable, reciprocating pistons 3 and 4. The pistons 3 and 4 are activated by means of suitable hydraulic control means, so that suitable pump pressures can be applied. The cross section of each of the pump units 1 and 2 is circular so that circular openings 5 and 6 are respectively provided at the one end thereof. The pump units containing the circular openings terminate in a pipe slide housing 7 in spaced-apart relationship with one another. The pipe slide housing 7 comprises a further circular opening 8 in a direction substantially perpendicular to the illustrated plane, a delivery pipe run (which is not shown in further detail) being connected to said opening 8. Said delivery pipe run is thus in direct communication with the interior of the pipe slide housing 7. A further opening 9 is provided opposite to the pump units 1 and 2 in the pipe slide housing 7, said opening 9 communicating with a suction line section 10.

Figure 1C:
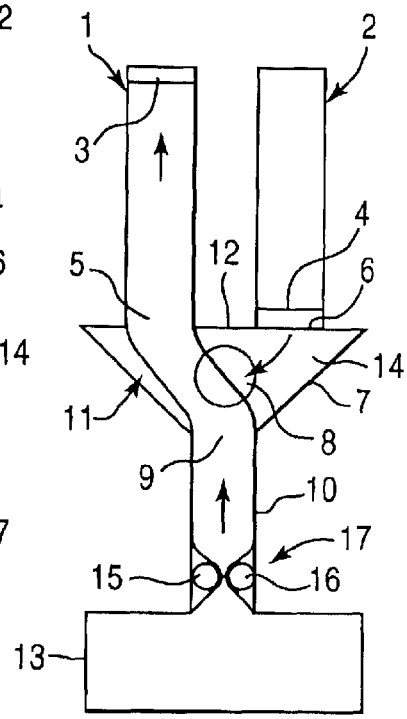
Figure 1D:
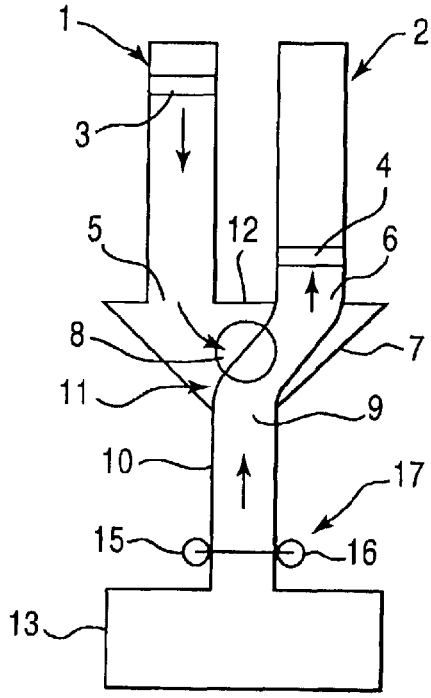

The opening 9 does not terminate in the interior of the pipe slide housing 7, but is part of an S-shaped pivot pipe body 11. The pivot or rotation axis of the pivot pipe body 11 is the center axis of the opening 9 at the same time. The opposite end of the pivot pipe body 11 slides on a plate 12, which is part of the pipe slide housing 7. Said opposite end can be made congruent with the opening 5 of the first pump unit 1 or with the opening 6 of the second pump unit 2. Thus, in dependence upon the switching position of the pivot pipe body 11, the suction line section 10 is once in communication with pump unit 1, as shown in FIG. 1*a*, or—in the other switching position—with the pump unit 2, as shown in FIG. 1*d*.

The suction line section 10 is connected at its other end with a supply container or filling hopper 13 into which the thick matter is filled. In the case of concrete, said material is e.g. filled by means of a mixer conveyor.

As can be seen from the drawings, the interior of the pivot pipe body 11 is part of the suction line, and the cavity 14 formed between the inside of the pipe slide housing 7 and the outside of the pivot pipe body 11 is part of the delivery line.

The suction line section 10 consists at least in part of an elastically deformable hose piece. This is a high-strength elastomer hose preferably provided with a reinforcement, as is already used in hose pumps for the delivery of thick matter. On the outside of the suction line section 1, there are provided squeezing elements 15, 16 which are movable at least at one place and can radially compress the suction line section 10. Said squeezing elements, preferably rollers, are activated by means of a hydraulic drive which can be coupled to the drive of the pump units 1 and 2. It is also possible that only one squeezing element acts on a fixed stop which has positioned thereon the suction line section 10. It is also possible that the squeezing elements 15, 16 are movable also axially relative to the suction line section 10 apart from their radial operative direction. They will then roll around shafts on the surface thereof, in particular in the direction of pump units 1 and 2.

The operation of the thick matter pump will now be explained in more detail in the following with reference to FIGS. 1*a* to 1*d*.

First of all, the thick matter, in particular concrete, is filled into the supply container 13. The squeezing elements 15, 16 of the pressure boosting device 17 are here in their opened state. The thick matter flows—due to is own weight and the supply container 13 which is mostly arranged at a higher level—at least in part into the suction line section 10. The pivot pipe body 11 is here in the position shown in FIG. 1*a* and connects the suction line section 10 to the pump unit 1. At the beginning the piston 3 of the pump unit 1 is positioned near the opening 5. In said position, the suction mode of the pump unit 1 starts and the piston 3 retracts. Due to the negative pressure thick matter is sucked through the suction line section 10 and the pivot pipe body 11 into the pump unit 1.

During the very first stroke the air amount is of course somewhat greater during the suction mode. Since the function of the thick matter pump during normal operation shall be explained in more detail, a normal filling with a standard air amount and an already filled delivery line shall be assumed for the following explanations.

After the piston 3 of the pump unit 1 has reached its final position or shortly before said position, the pressure boosting device 17 is activated. To this end the squeezing elements 15 and 16 move towards each other, thereby pressing the flexible suction line section 10 together until said section is closed at the squeezing point. Due to this operation thick matter is simultaneously pressed into the suction line section 10 via the pivot pipe body 11 and into the pump unit 1, resulting in a precompression. Since the thick matter as such is relatively difficult to compress and since the air amount, which is much smaller in terms of percentage, must mainly be compressed, a respectable increase in pressure of the thick matter can be achieved through a relatively small deformation of the suction line section 10. If a pure radial deformation of the suction line section 10 cannot be achieved with the help of the squeezing elements 15, 16, said elements can still be displaced in axial direction, resulting in a further increase in pressure.

Due to the pressing of the thick matter into the pump unit 1, there is an optimum filling in the entirely retracted state of piston 3. Said state is shown in FIG. 1*c*. During the whole preloading operation, the piston 4 of the pump unit 2 conveys thick matter into the delivery line. Due to the forward movement of the piston 4 towards the pipe slide housing 7, the thick matter positioned therein is pressed into cavity 14 and from opening 8 into the delivery line section arranged thereat. The thick matter in the suction line is preferably preloaded at the same pressure as the squeezing out of the thick matter by means of piston 4. Subsequently, according to FIG. 1*d*, the pivot pipe body 11 is pivoted, so that the pump unit 1 communicates via the opening 5 with the cavity 14 of the pipe slide housing 7 and pump unit 2 is connected to the suction line. As soon as the pivot pipe body 11 has been entirely pivoted into its second position, the pressure boosting device 17 opens by retracting the squeezing elements 15 and 16 (see FIG. 1*d*). As soon as there is a negative overlap of the pivot pipe body 11 with the opening 5 upon switching from the position of FIG. 1*c* into the position of FIG. 1*d*, the preloaded contents of the pump unit 1 is immediately in communication with the also pressurized thick matter in the pipe slide housing 7. A compression of the thick matter in pump unit 1 does not take place because of the delivery pressure that has now been exerted because the matter is already preloaded accordingly.

At least two actuation variants exist for the switching operation. Either the piston 3 starts with its pump stroke only after the pivot pipe body 11 has fully been pivoted to the other pump unit 2, or both pistons 3 and 4 carry out a pump stroke at half the delivery rate during the switching operation. This means in the second case that piston 3 already starts to move when piston 4 has just completed its pump stroke.

After a complete switching according to FIG. 1*d*, piston 3 will then move at its full speed, whereas piston 4 starts its suction stroke and sucks thick matter via the suction line section from the supply container 13. The pumping operation will then be continued with exchanged pump units.

Thanks to the achievement of an optimum filling of the pump units in the suction mode and the additional preloading by the pressure boosting device 17, the capacity of the pump units 1 and 2 can be fully exploited. In comparison with pump units of a similar type in which a compression is carried out by piston 3 or 4 itself, this results in an improved efficiency of up to 20%.

On the basis of FIGS. 2*a* to 2*i*, a variant of the preceding embodiment shall now be explained in more detail. The main difference consists in the actuation of the thick matter pump and in a fundamentally different structure.

Insofar as the same constructional elements as in the preceding embodiment are resorted to, identical reference numerals will be used and reference will be made to the preceding description.

Figure 2A:
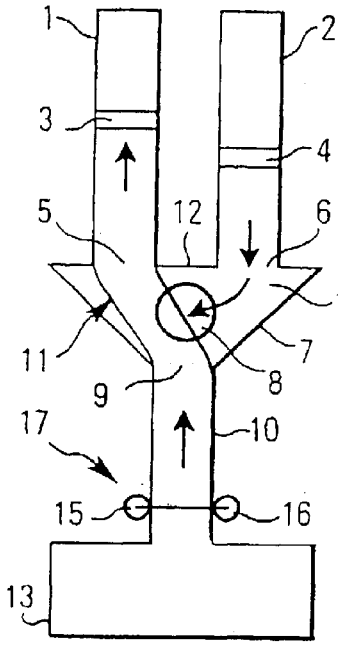
FIGS. 2*a* to 2*i* show a schematic process sequence of a second embodiment in a two-cylinder thick-matter pump.
Figure 2B:
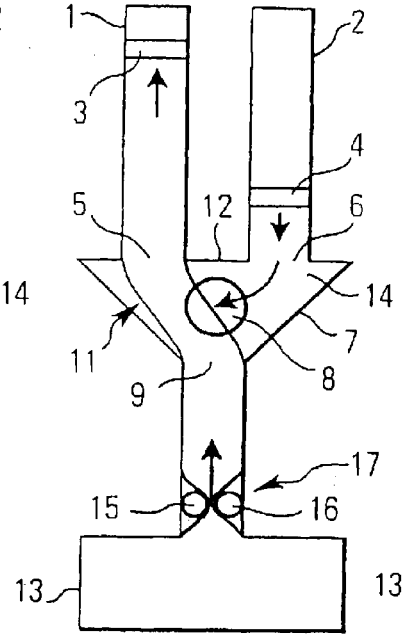
Figure 2C:
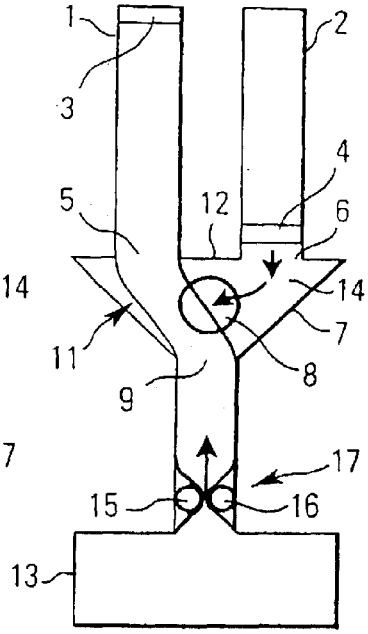
Figure 2D:
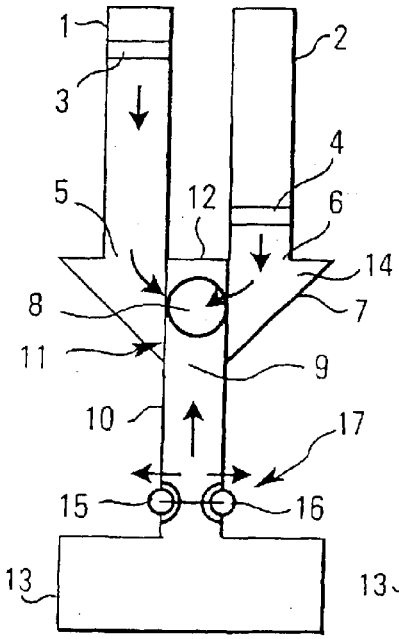

According to FIG. 2*a* the pump unit 1 is in the suction mode and the pump unit 2 in the pump mode. The pressure boosting device 17 is open so that material can be sucked from the supply container 13 into the pump unit 1. Subsequently, the pressure boosting device 17 is actuated towards the end of the suction mode according to FIGS. 2*b* and 2*c*, so that the pump unit 1 is filled completely and a preload exists due to an increase in pressure. While the piston 4 continues its conveying action, the pivot pipe body 11 switches into a central position. At the same time the delivery rate of the piston 4 is halved and piston 3 starts its pumping operation at half the delivery rate. Thus, both pistons 3 and 4 deliver at the same time, but with the same volume flow as before.

In said intermediate position, the end of the pivot pipe body that rests on the plate 12 does not communicate with opening 5 or 6 of the pump unit 1 or 2. The pressure boosting device 17 opens due to a radial moving apart of the squeezing elements 15 and 16. According to FIG. 2*e* the piston 4 completes its pump stroke and ends substantially in planar fashion with the plate 12, thereby closing opening 6. As soon as piston 4 stops its pumping stroke, piston 3 will continue to move at the normal delivery rate, so that the volume flow which is pressed out of opening 8 is maintained.

Subsequently, the pivot pipe body 11 switches or pivots completely into its second position in which it connects the suction line section 10 to the pump unit 2. The pump unit 2 will then begin with the suction mode by retracting the piston 4. The switching operation from the position of FIG. 2*e* into the position of FIG. 2*f* has no influence on the delivery flow because the piston 4 prevents any short-circuiting between pivot pipe body 11 and pipe slide housing 7.

Figure 2E:
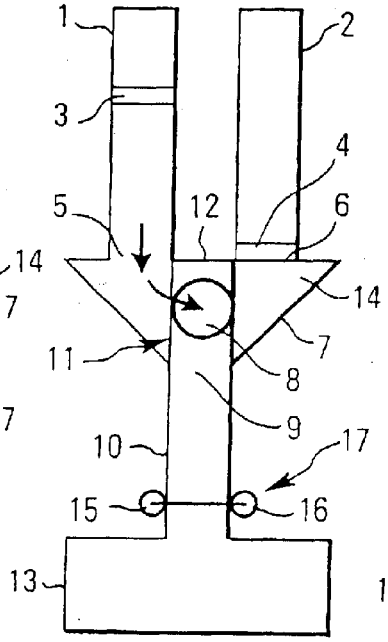
Figure 2F:
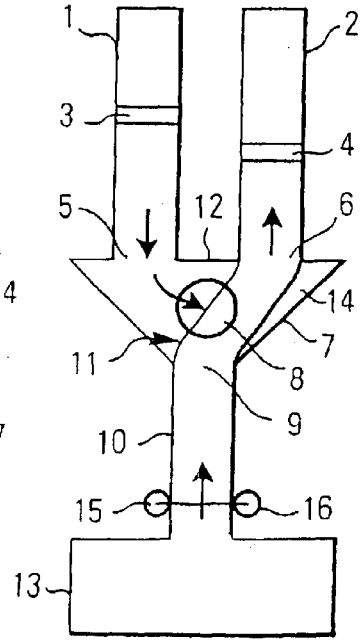
Figure 2G:
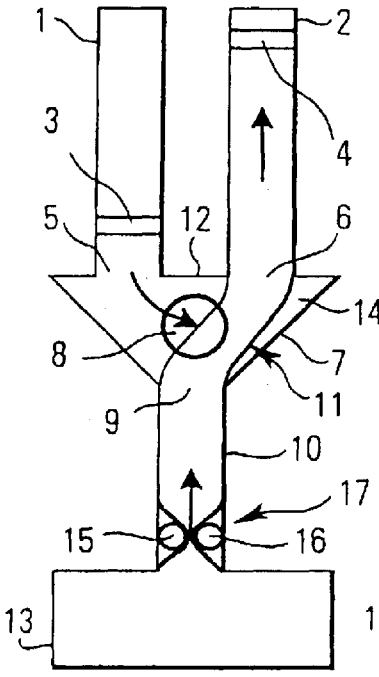
Figure 2H:
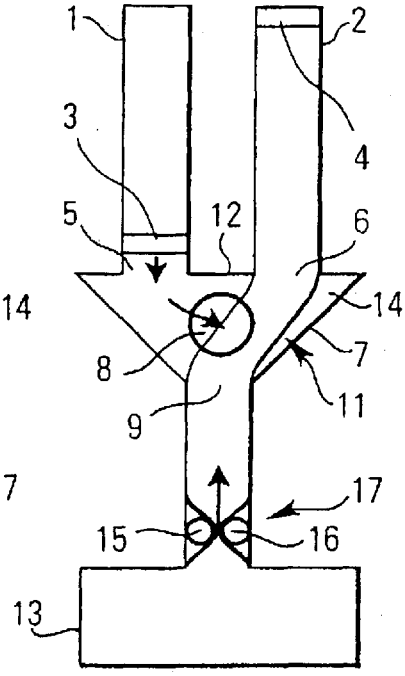

Towards the end of the suction mode according to FIG. 2*g* and 2*h*, the pressure boosting device 17 will resume its operation, ensuring a complete filling of the pump unit 2 with a corresponding preload. The preload pressure should here also be substantially identical with the delivery pressure in the delivery line, in particular in the pipe slide housing 7.

Figure 2I:
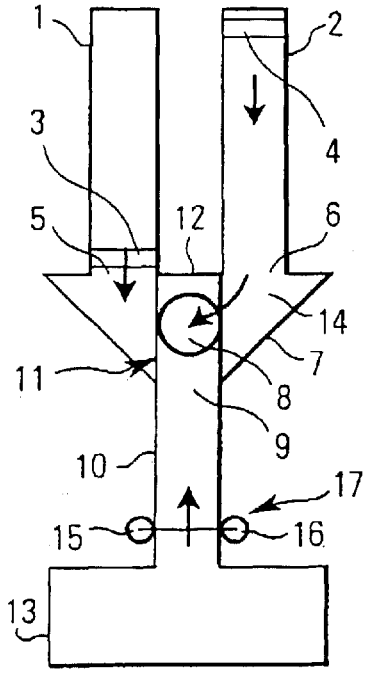

FIG. 2*i*, in turn, shows the switching operation into the other direction, equivalent to FIG. 2*e*. Both pistons 3 and 4 are then in the pump stroke, each at half the speed.

This method can also be employed in an embodiment in which the pivot pipe body 11 is not in constant communication with the suction line section, but communicates with the delivery line. In such an embodiment the sucking operation is carried out via the pipe slide housing. In the described embodiments adjusting means may additionally be provided for adjusting the pressure boosting device so as to be able to adjust different compressions of the thick matter. Moreover, there may also be an overload protection for limiting the maximum compaction of thick matter and for avoiding an overloading of the thick matter pump.

The specific design of a thick matter pump according to the invention is also excellently suited for retrofitting existing pump systems. Even thick matter pumps without any pump units, which can be actuated according to the variant of FIGS. 2*a* to 2*i*, can be provided with a pressure boosting device at a later time, resulting in a continuous delivery flow in such a case as well. This means that even the simplest form of thick matter pumps can be used for large delivery heights. Large delivery heights cause vibrations which play a very important role because of a discontinuous delivery flow. In particular compression strokes which during the switching operation are created by a sudden compression of the thick matter volume in a pump unit are eliminated by the preload.

According to further variants, the pressure boosting device is e.g. provided with a membrane or formed by a cylindrical piston unit. Moreover, the pumping capacity of the pressure boosting device can also be greater than the suction capacity of one of the pump units. An advantageous housing is obtained in that at least part of the inner wall of the housing can be provided at least in portions with wear elements. Moreover, in one variant, the housing may comprise at least one closable maintenance or cleaning opening. A vertically adjustable and pivotable supply container also offers some advantages in one variant.

The method can also be supplemented by an additional step in which in the end phase of the suction mode of one of the pump units the pressure boosting device is activated at a capacity superposing the suction mode of said pump unit. In particular, the second pump unit can simultaneously end the suction mode with the precompressing and pressing operation.

What is claimed is:

1. A thick matter pump comprising at least two pump units (1,2) means for operating said pumping units alternately in the pump and suction mode, a delivery line, a suction line, and a switching valve (11) for switching between said pump units (1,2), one of said pump units (1,2) being connected in the pump mode by said switching valve (11) to said delivery line, and the other one of said pump units (1,2) being connected in the suction mode to said suction line, characterized in that a pressure boosting device (17) which operates independently of said pump units (1,2) is provided for compressing thick matter in said suction line for actively effecting a thick matter compression.

2. The thick matter pump according to claim 1, characterized in that said suction line comprises an elastically deformable section (10) and said pressure boosting device (17) comprises squeezing elements (15, 16) by which said elastically deformable section (10) of said suction line can be compressed for increasing the pressure.

3. The thick matter pump according to claim 2, characterized in that said elastically deformable section (10) of said suction line is a hose piece.

4. The thick matter pump according to claim 1, characterized in that said pressure boosting device comprises a membrane.

5. The thick matter pump according to claim 1, characterized in that said pressure boosting device comprises a cylinder/piston unit.

6. The thick matter pump according to any one of claims 1 to 5, characterized in that the pumping capacity of said pressure boosting device is greater than the suction capacity of one of said pump units (1, 2).

7. The thick matter pump according to any one of claims 1 to 3, characterized in that said pressure boosting device (17) comprises adjusting means for adjusting the precompression of thick matter.

8. The thick matter pump according to any one of claims 1 to 4, characterized in that said pressure boosting device comprises an overload protection for limiting the maximum precompression of thick matter.

9. The thick matter pump according to claim 2, characterized in that said squeezing elements (15, 16) of said pressure boosting device (17) are operable by means of a hydraulic device.

10. The thick matter pump according to claim 1, characterized in that said pump units (1, 2) are delivery cylinders including delivery pistons.

11. The thick matter pump according to claim 1, characterized in that said switching valve is a pipe slide including a pivot pipe body (11).

12. The thick matter pump according to claim 11, characterized in that said pipe slide comprises a housing (7) which surrounds said pivot pipe body (11) at least in portions at a distance, that a cavity (14) formed between said housing (7) and said pivot pipe body (11) is part of said delivery line, and said pivot pipe body (11) which is switchable between said pump units (1, 2) is part of said suction line.

13. The thick matter pump according to claim 11, characterized in that said pipe slide comprises a housing (7) surrounding said pivot pipe body (11) at least at a distance, that a cavity (14) formed between said housing (7) and said pivot pipe body (11) is part of said suction line, and that said pivot pipe body (11) which is switchable between said pump units (1, 2) is part of said delivery line.

14. The thick matter pump according to claim 12 or 13, characterized in that at least part of the inner wall of said housing (7) is provided at least in portions with wear elements.

15. The thick matter pump according to claim 14, characterized in that said housing (7) comprises at least one closable maintenance or cleaning opening.

16. The thick matter pump according to claim 12, characterized in that said housing (7) comprises at least one closable maintenance or cleaning opening.

17. The thick matter pump according to claim 1, characterized in that an end of said suction line is connected to a supply container (13).

18. The thick matter pump according to claim 17, characterized in that said supply container (13) is vertically adjustable and pivotable.

19. A suction/pumping method of a thick matter pump according to claim 1, the method comprising the following steps:

connecting said delivery line to a first pump unit (1);

connecting said suction line to a second pump unit (2);

said first pump unit (1) switching to pump mode;

said second pump unit (2) switching to suction mode;

precompressing and pressing said thick matter in said suction line by means of a pressure boosting device (17) performing compression independently of said first pump unit (1) until the desired precompression or filling amount is achieved in said second pump unit (2).

20. The method according to claim 19, characterized in that said second pump unit (1,2) is at a standstill during the precompression step by said pressure boosting device (17) or terminates the suction mode.

21. The method according to claim 19 or 20, characterized in that in the end phase of said suction mode of said second pump unit (2) said pressure boosting device is activated at a capacity superposing the suction mode of said second pump unit (2).

22. The method according to claim 21, characterized in that said second pump unit (2) terminates the suction mode at the same time with the precompressing and pressing operation.

23. The method according to claim 22, characterized in that a pressure build up in said suction line by precompression, said pressure being substantially identical with the pressure prevailing in said delivery line during the pump mode.

24. The method according to claim 20, characterized in that in the end phase of said suction mode of said second pump unit (2) said pressure boosting device is activated at a capacity superposing the suction mode of said second pump unit (2).

25. The method according to claim 19, characterized in that a pressure is built up in said suction line by precompression, said pressure being substantially identical with the pressure prevailing in said delivery line during the pump mode.

26. The method according to claim 19, characterized that both pump units (1, 2) operate with half the volume flow in the pump mode during a switching operation from said first to said second pump unit (1, 2).

* * * * *